United States Patent [19]

Boram

[11] Patent Number: 4,717,177

[45] Date of Patent: Jan. 5, 1988

[54] ABSENTEE BALLOTING SYSTEM

[75] Inventor: Robert J. Boram, Quakertown, Pa.

[73] Assignee: R. F. Shoup Corporation, Bryn Mawr, Pa.

[21] Appl. No.: 770,053

[22] Filed: Aug. 27, 1985

Related U.S. Application Data

[63] Continuation of Ser. No. 608,158, May 8, 1984, abandoned.

[51] Int. Cl.[4] ..... B42D 15/00; G09F 3/00

[52] U.S. Cl. ..... 283/5; 283/73; 283/74; 283/81

[58] Field of Search ..... 283/5, 73, 74, 81; 235/51, 57; 434/306

[56] References Cited

U.S. PATENT DOCUMENTS

| | | | |
|---|---|---|---|
| 340,218 | 4/1886 | Kinnard | 283/5 |
| 830,979 | 9/1906 | Dunn | 283/5 |
| 1,410,984 | 3/1922 | Baker | 283/5 |
| 2,190,019 | 2/1940 | Foster | 283/5 |
| 3,207,531 | 9/1965 | Vilven | 283/5 |
| 3,211,470 | 10/1965 | Wilson | 283/81 |
| 3,460,854 | 8/1969 | Koelling | 283/5 |
| 3,471,172 | 10/1969 | Bayha | 283/74 |
| 3,648,022 | 3/1972 | Cook . | |
| 3,708,656 | 1/1973 | Fielder | 283/5 |
| 4,166,144 | 8/1979 | Amberkar | 283/81 |
| 4,227,643 | 10/1980 | Luther . | |

*Primary Examiner*—Paul A. Bell
*Assistant Examiner*—Paul M. Heyrana, Sr.
*Attorney, Agent, or Firm*—Woodcock Washburn Kurtz Mackiewicz & Norris

[57] ABSTRACT

An improved ballot structure for use in connection with absentee balloting is disclosed which features removable adhesive-backed labels having indicia printed thereon of the names of candidates for particular offices. Voters detach these labels and paste them in spaces corresponding to the office for which they desire to vote. The number of spaces per office corresponds to the total number of candidates for which the voter is entitled to vote. The portion of the ballot containing the labels is detached by the voter and discarded and the portion containing the sticker selected by the voter is then supplied to election officials. In this way, improved election security is achieved in a simple, low cost and effective ballot structure. Preferably, the labels have bar coded representations of the candidates' names printed thereon, for ready tabulation by machine.

6 Claims, 2 Drawing Figures

OFFICIAL ABSENTEE BALLOT
Precinct # 15
Charlotte NC

May 1, 1984 PRIMARY ELECTION

INSTRUCTIONS TO VOTER

To vote for an office or proposition, remove the sticker for the candidate of your choice from the right-hand side of the ballot.

Fasten the sticker to the left-hand side of the ballot inside the box under the office title. You may vote for as many candidates as there are boxes.

When finished, remove the right-hand side of the ballot with the unused candidate stickers, discard it, and return the left-hand side (your ballot) to election officials.

GOVERNOR

Vote for 1

113

AFFIX YOUR CHOICE HERE

112

106 110

RICHARD WOLF

108

JOHN DOE

MARY C. LIND

WILLIAM SMITH

RICHARD ROE

STATE SENATOR

Vote for 2

114

110

WILLARD NOYES

GEORGE KEYES

AFFIX YOUR CHOICE HERE

SAMMY SPADE

WILSON GOODRICH

AFFIX YOUR CHOICE HERE

DAVID JOHNSON

HARTFORD BELL

EDWARD LAWYER

CHARLES WILSON

JOSEPH AMDEX

PAULA SMYTHE

Fig. 2

ABSENTEE BALLOTING SYSTEM

This is a continuation of application Ser. No. 608,158, filed 5/8/84 abandoned 2/27/85.

FIELD OF THE INVENTION

This invention relates to improvements in voting systems. MOre particularly, the invention relates to an improved absentee or emergency balloting system which is simpler than prior art absentee ballot systems, which is readily amenable to electronic voting systems which are becoming increasingly desirable, and which provides for improved election security.

BACKGROUND AND OBJECTS OF THE INVENTION

The election of public officials in the United States and other countries has typically proceeded in the past by use of mechanical voting machines at predetermined polling places. Where an individual is unable to attend his polling place on the election day he may be provided with an absentee ballot by election officials. He anonymously selects his choices and mails or otherwise returns the absentee ballot to the election officials. However, the various absentee balloting systems used in the past have been fraught with numerous opportunities for election inaccuracy or fraud and it is therefore an object of the invention to provide an improved absentee balloting system which is more completely immune from fraud than prior art systems.

Another trend in electoral practice in the United States is toward electronic voting machines. Copending Ser. No. 608,157 filed May 8, 1984 for an Electronic Voting Machine and System discusses an electronic voting system in which mechanical voting machines are eliminated in favor of programmable electronic voting machines. It would clearly be desirable if a secure, i.e. tamperproof, absentee balloting system could be included in such an electronic voting system. More particularly, it would be desirable to provide an absentee ballot directly readable by computer data input means, so as to include absentee ballots in computer tabulated election results, and such is another object of the invention.

It is a further object of the invention to provide an absentee ballot which can also be readily printed by a printer under control of the computer, so as to simplify preparation for elections, using the same database as is used for programming the electronic voting machines.

Those skilled in the art will also recognize that any voting machine, whether mechanical or electronic or a combination of both, is subject to breakdown and that emergency ballots must be provided so that voters are not deprived of their franchise.

It is an object of the invention to provide an emergency ballot system which is essentially identical to the absentee ballot system in a particular locality so as to simplify generation of these ballots and their tabulation and to ensure that appropriate security is provided for the electoral process.

It is a further object of this invention to provide an absentee ballot which restricts the voter from voting for more candidates for any office than that number for which he is legally entitled to vote.

SUMMARY OF THE INVENTION

The above mentioned needs of the art and objects of the invention are satisfied by the present invention which comprises an absentee balloting system for use in conjunction with an electronic voting machine. The absentee ballot comprises a preprinted paper ballot produced by a computer-operated printer having a number of removable adhesive-backed labels having the candidates' names printed thereon. Preferably the labels additionally contain a bar coded representation of the candidates' names and are specifically identified by bar-coded ballot number. A voter desiring to cast his vote for a particular candidate simply removes the appropriate adhesive backed label and pastes it in a designated position corresponding to the office. The ballot is made in two detachable halves, one containing the candidate labels, the other having spaces marked for the offices. To prevent the voter from overvoting, i.e. selecting more candidates than he is legally entitled to select, the number of positions for candidate stickers for an office is restricted to the legal number of candidates which may be selected. After completing voting, the voter detaches the remaining preprinted stickers and discards them and mails or delivers to the election officials only the office half of the ballot. Because each of the preprinted stickers has a unique identifying ballot number on it, it is not readily possible for the election officials to print additional labels for candidates of their choosing. Similarly, the labels can be provided with glues which are sufficiently adhesive such that a candidate label, once affixed by the voter, cannot be detached by a venal election official without destroying or damaging the ballot in a visually noticeable fashion. Provision of the bar code enables a prior art bar code reader to be utilized to read the absentee ballot into a computerized vote tabulation system thus greatly simplifying tabulation of absentee ballots.

BRIEF DESCRIPTION OF THE DRAWINGS

The invention will be better understood if reference is made to the accompanying drawings in which:

FIG. 2 shows the absentee ballot according to the invention.

DESCRIPTION OF THE PREFERRED EMBODIMENTS

Figure 1:
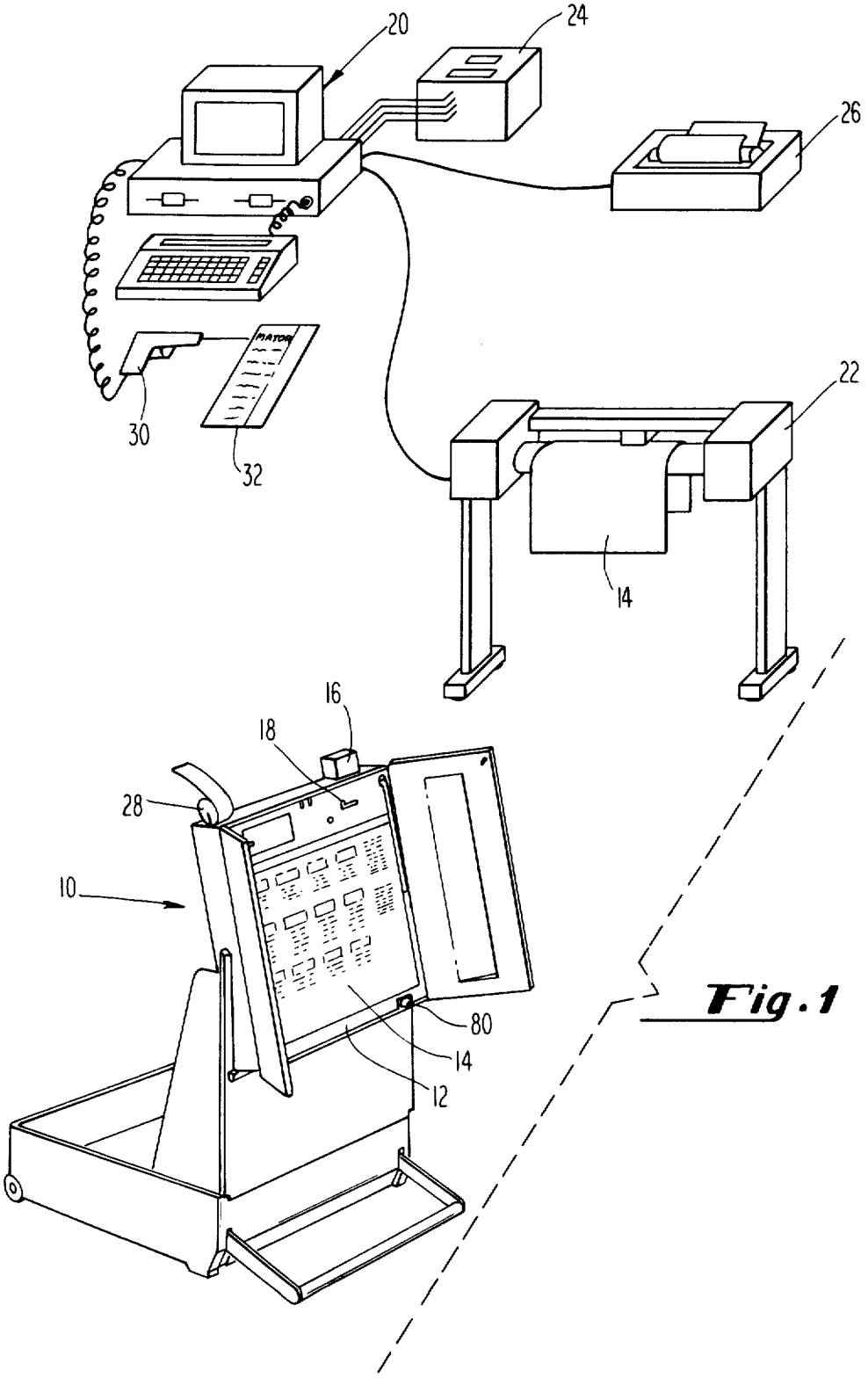
FIG. 1 shows an overall view of the electronic voting system of the invention.

FIG. 1 shows an overall view of the electronic voting system according to the invention as more fully detailed and claimed in copending application Ser. No. 608,157 filed May 8, 1984 incorporated herein by reference. An electronic voting machine 10 comprises a planar array 12 of push button type switches which are overlayed by a paper ballot 14. The paper ballot and a covering protective layer of clear plastic are sufficiently flexible that the individual voting switches of the array 12 can be depressed through the paper and the plastic. The voting machine is supplied in an unprogrammed state and is "programmed" or "set up" for a particular election by supply thereto of a memory cartridge 16 which carries signals from a computer 20 operated by election officials to associate individual ones of the switches with individual candidates, and by supply thereto of a paper ballot 14 printed correspondingly to identify the switches with the candidates. The voting machine may also comprise a printer 28 for outputting a visible record of the tallies of the election at its conclusion.

As mentioned, the voting system of the invention further comprises a personal computer or other computing device 20 which is operated by the election officials by inputting election data including the names of the candidates, their corresponding offices and any legal restrictions on voting. The computer 20 can generate a draft ballot copy on a printer 26 and then generates a paper ballot 14 on the printer 22. Memory cartridge 16 comprises a programmable read only memory (PROM) and is programmed by a conventional PROM programmer/reader 24. Details of the memory cartridge are found in copending Ser. No. 608,159 filed May 8, 1984 incorporated herein by reference.

According to the present invention, an absentee ballot 22 which comprises bar code candidate and possibly office identification is read by a conventional bar code reader 30 such as those manufactured by Hewlett-Packard Company. In this way absentee ballots are readily tallied by the computer system. Votes cast on the electronic voting machine are tallied on the memory cartridge 16, which is reinserted into the PROM programmer/reader 24 for input thereof to the computer system 20.

FIG. 2 shows a sample absentee ballot which comprises left and right halves separated by a score line 114 along which the ballot can be torn in half. As indicated in the instructions to voters reproduced in FIG. 2, to vote one simply selects the label 110 having the name of the candidate of one's choice printed thereon. Each label is supplied with a bar code 108 identifying the candidate whose name appears at 106. The bar code typically also includes a ballot number. These labels 110 are punched around their peripheries so as to be detachable from the body of the right hand half of the ballot, and are provided with adhesive backing, to be readily affixed to the left hand half of the ballot, near the name of the corresponding office. The name of the office is desirably similarly bar coded, as at 113. The spacaes within which the labels are pasted in order to vote may be printed with a "No Vote" code, to provide the corresponding indication to the tabulation system. After having completed voting, the voter detaches the right half along the score line 114 and discards it, thus discarding along therewith all the unused bar coded labels 110. He then delivers the left half of the ballot to election officials for tabulation. The fact that the unused labels are discarded ensures that venal election officials cannot place a different label over his choice. The voter of course is permitted this option. However, the glue selected to bind the labels is such that once they have been attahced to the candidate area, they cannot be removed without damaging or destroying the ballot. In this way, officials cannot detach labels casting votes for candidates they do not support. Furthermore, encoding a unique ballow number ensures that venal election officials will effectively be prevented from producing labels to cover labels for candidates duly voted-for.

It will be appreciated by those skilled in the art that the production of such ballots is a relatively straightforward matter, given the present state of computer technology. As shown in FIG. 1, a computer 20 and printer 26 such as the IBM "PC" personal computer and the Hewlett-Packard 2932A printer can readily be programmed to produce absentee ballots as shown in FIG. 2 on prepunched, adhesive backed label forms, including plotting of the bar coded representation of the candidates' names and individual ballot numbers on each label. It will similarly be appreciated that reading of the bar coded stickers by reader 30, including verifying the ballot number, is well within the skill of the art and can be performed using commercially available equipment.

It will also be appreciated that by printing bar coded identification 113 of the office corresponding to each group of candidates the computer can be provided with the candidates' name and the office for which the vote was cast at the same time providing a further check. Another possibility would be to only print the bar code representation of the candidates' names on the labels, printing the literal names on the body of the right-hand half of the ballot 80, so that they would be discarded by the voter. This would make it much more difficult for corrupt officials to locate and destroy or deface ballots for candidates they did not support.

It will also be appreciated by those skilled in the art that the absentee balloting system of the invention has applicability to prior art mechanical voting systems in that use of labels with non-removable adhesive would be useful in connection with human as well as bar code reading of the labels.

It will also be appreciate that throughout this specification, "absentee ballot" should be construed to include emergency ballots, used for example when mechanical or electronic voting machines break down, as the problems faced in connection with such emergency ballots are very similar to those faced in the absentee ballot situation.

Therefore, while a preferred embodiment of the invention has been shown and described, the invention should not be so limited, but is bounded only by the following claims.

What is claimed is:

1. An absentee balloting system comprising a printed ballot having first and second halves, the halves being separable from one another along a score line, a first one of said halves containing pre-printed adhesive-backed labels indicative of candidates for a given one of a plurality of offices and the second of said halves containing spaces corresponding to said offices, said labels being detachable from said first half of said ballot and affixable to said second half of said ballot so as to effectuate a vote for a given candidate, wherein the adhesive backing said labels is formed to adhere to said second half of said ballot, upon affixation by an absentee voter, in a manner causing detactable damage to said second half of said ballot upon the occurrence of an attempted removal of one or more of the previously affixed labels therefrom.

2. The ballot structure of claim 1 wherein said labels comprise encoded identifiers of the corresponding candidates.

3. The ballot structure of claim 2 wherein said encoded identifiers are bar code.

4. The ballot structure of claim 2 wherein said second half of said ballot structure comprises similarly coded identifiers of the individual offices for which the voters may vote.

5. The ballot structure of claim 1 wherein all of said labels on a given ballot are provided with a unique ballot identifier.

6. An absentee balloting system for use in conjunction with an electronic voting system including a bar code reader adapted to supply input data to a vote-tabulating computer said absentee balloting system comprising a ballot having a plurality of bar code office identifiers juxtaposed to respective one of a plurality of office titles printed thereon in a first portion, and a plurality of bar code candidate identifiers juxtaposed to respective ones of a pluraltiy of candidate names printed thereon in a second portion, either said plurality of bar code candidate identifiers or said plurality bar code office identifiers being printed on labels adapted to be removable from their respective portion of said ballot and adhesively affixable to the other portion of said ballot, such that the voter may physically associate a bar coded candidate identifier with a bar coded office identifier, and the vote thus indicated can be read by the bar code reader.

* * * * *

UNITED STATES PATENT AND TRADEMARK OFFICE

CERTIFICATE OF CORRECTION

PATENT NO. : 4,717,177

DATED : January 5, 1988

INVENTOR(S) : Robert J. Boram

It is certified that error appears in the above-identified patent and that said Letters Patent is hereby corrected as shown below:

Column 3, line 50, please change the word "choice" to --choices--.

Column 3, line 56, please change the word "ballow" to --ballot--.

Signed and Sealed this

Seventh Day of June, 1988

*Attest:*

DONALD J. QUIGG

*Attesting Officer*

*Commissioner of Patents and Trademarks*